US009415840B1

(12) United States Patent
Bitterburg, Jr.

(10) Patent No.: US 9,415,840 B1
(45) Date of Patent: Aug. 16, 2016

(54) COLLAPSIBLE TRIANGULAR WATERCRAFT TOW DEVICE

(76) Inventor: Robert L. Bitterburg, Jr., Waterford, MI (US)

( * ) Notice: Subject to any disclaimer, the term of this patent is extended or adjusted under 35 U.S.C. 154(b) by 0 days.

(21) Appl. No.: 13/419,529

(22) Filed: Mar. 14, 2012

(51) Int. Cl.
*B63B 21/56* (2006.01)
*B63B 21/58* (2006.01)

(52) U.S. Cl.
CPC ..... *B63B 21/58* (2013.01)

(58) Field of Classification Search
USPC ..... 114/242, 249, 250, 253; 280/458, 482, 280/483, 492, 493; 441/69
See application file for complete search history.

(56) References Cited

U.S. PATENT DOCUMENTS

| | | | | |
|---|---|---|---|---|
| 3,765,704 | A * | 10/1973 | Tierno | 280/482 |
| 4,453,487 | A | 6/1984 | Vinnari | |
| 5,188,054 | A * | 2/1993 | Jacobs, Jr. | 114/250 |
| 5,927,226 | A | 7/1999 | Patterson | |
| 6,295,943 | B1 | 10/2001 | Brushaber et al. | |
| 6,766,756 | B1 | 7/2004 | Cardaci | |
| 7,013,822 | B2 * | 3/2006 | Gencarelli | 114/249 |
| 7,959,180 | B1 * | 6/2011 | Huston et al. | 280/493 |

* cited by examiner

*Primary Examiner* — Lars A Olson
(74) *Attorney, Agent, or Firm* — Crossley Patent Law

(57) ABSTRACT

The collapsible triangular watercraft tow device provides for towing an object or device behind a tow watercraft. The triangular shape provides best portability combined with superior towing characteristics and basic, inexpensive construction and sale. The pivot hinge and adjustable length of the device further accommodate various tow watercraft and towed objects and watercraft.

18 Claims, 5 Drawing Sheets

COLLAPSIBLE TRIANGULAR WATERCRAFT TOW DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Towing an object behind a watercraft has always presented a challenge in attempting to control the towed object. Typically such objects, be they other watercraft of any sort or any other device, present problems of collision with the tow craft, other watercraft, and other objects. Previously proposed solutions to these problems have often been overly complex, heavy, difficult to use, and sometimes difficult to transport, even if properly functional. The present device solves these problems.

FIELD OF THE INVENTION

The collapsible triangular watercraft tow device relates to towing devices and more especially to a tow device used by a watercraft to tow another watercraft or object safely and effectively, without damage to any related craft or object.

SUMMARY OF THE INVENTION

The general purpose of the collapsible triangular watercraft tow device, described subsequently in greater detail, is to provide a collapsible triangular watercraft tow device which has many novel features that result in an improved collapsible triangular watercraft tow device which is not anticipated, rendered obvious, suggested, or even implied by prior art, either alone or in combination thereof.

To attain this, the collapsible triangular watercraft tow device provides a device for towing various other objects and watercraft, such as a jet ski for example, in a controllable fashion behind a tow watercraft. The device negates collisions and damage to the towed object, other proximal objects, other watercraft, and the tow watercraft that are heretofore typical in such practices. The device may include a pair of first extensions, a second extension removably affixed to each first extension, and third extension removably affixed to each second extension. The first extensions are each swivelly affixed to a ring. The ring is most easily removably affixed to an object or craft being towed by the tow watercraft by a connector. The most complete version of the device features extensions that are adjustably fit to the next extension such that full combined extension lengths are adjustable. Further, a most complete embodiment of the device may include a crossbar removably affixing each second extension to the other second extension. The crossbar may also provide adjustable length in the connection of the two second extensions, and thereby enable the adjustability of the lengths of the combined first extensions and second extensions. The ability to adjust the overall length of the device enables adaptation to various objects and watercraft that are towed. Length adjustability of the various components may feature multiple orifices in the extensions and in the crossbar with the chosen lengths determined by detent pins. Yet another more complete embodiment of the device features a pivot hinge disposed between the proximal end and the distal end of the third extension, thereby allowing for height differences between the tow watercraft and a towed object or watercraft.

The connectors used to connect the device to a tow watercraft and to a towed object or other watercraft may be comprised of mechanical forms, including a carabiner. The extensions may all be padded.

The triangular shape of the device provides more than one advantage. To cite one, the less complex and bulky the device the more easily transported and used. Further, the triangular shape provides excellent stability in towing an object or watercraft without the need of more complex designs associated with non-triangular devices.

Thus has been broadly outlined the more important features of the improved collapsible triangular watercraft tow device so that the detailed description thereof that follows may be better understood and in order that the present contribution to the art may be better appreciated.

An object of the collapsible triangular watercraft tow device is to provide for towing objects and watercraft by a tow watercraft.

Another object of the collapsible triangular watercraft tow device is to provide for stable towing of objects and watercraft by a tow watercraft.

A further object of the collapsible triangular watercraft tow device is to be collapsible.

An added object of the collapsible triangular watercraft tow device is to provide a v-shaped device.

And, an object of the collapsible triangular watercraft tow device is to provide a v-shaped device that is length adjustable.

Yet another object of the collapsible triangular watercraft tow device is to provide a v-shaped device that is width adjustable.

Another object of the collapsible triangular watercraft tow device is to provide a v-shaped device that is easily and quickly connected and disconnected.

And, an object of the collapsible triangular watercraft tow device is to negate the use of tools in the attachment and detachment of the device.

An object of the collapsible triangular watercraft tow device is to negate the need for specialized hitches.

Still another object of the collapsible triangular watercraft tow device is to provide for attachment of the device to existing attachment mechanisms on the towed object and the tow watercraft.

These together with additional objects, features and advantages of the improved collapsible triangular watercraft tow device will be readily apparent to those of ordinary skill in the art upon reading the following detailed description of presently preferred, but nonetheless illustrative, embodiments of the improved collapsible triangular watercraft tow device when taken in conjunction with the accompanying drawings.

DETAILED DESCRIPTION OF THE DRAWINGS

With reference now to the drawings, and in particular FIGS. 1 through 6 thereof, the principles and concepts of the collapsible triangular watercraft tow device generally designated by the reference number 10 will be described.

Figure 2:
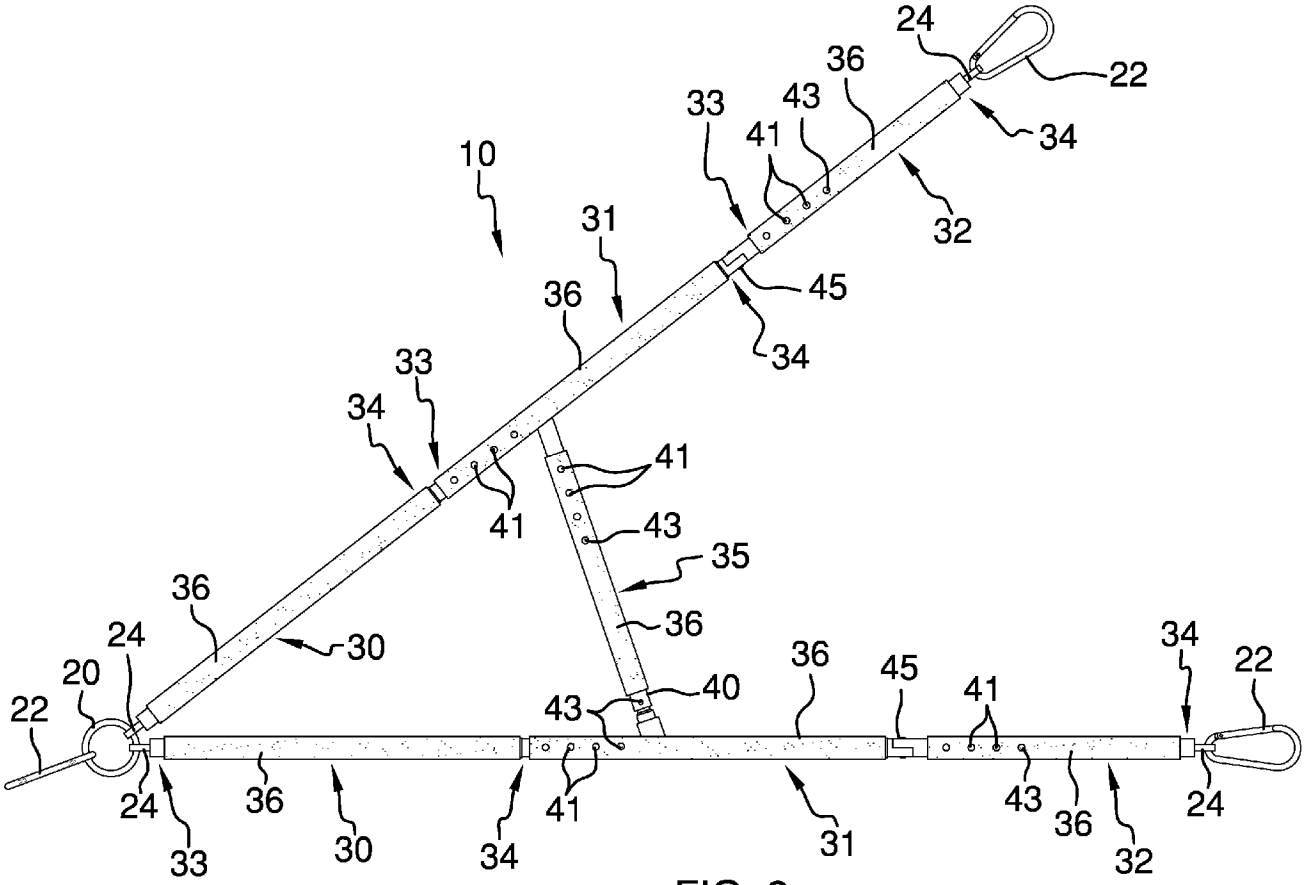
FIG. 2 is a top plan view of FIG. 1.

Referring to FIG. 2, the device 10 partially comprises a ring 20. A connector 22 is removably and swivelly connected to the ring 20. A pair of ring attachments 24 is swivelly affixed to the ring 20. A first extension 30 is affixed to each ring attachment 24. A second extension 31 is removably affixed to each first extension 30. A third extension 32 is removably affixed to each second extension 31. A crossbar 35 is removably affixed to each second extension 31.

Figure 3:
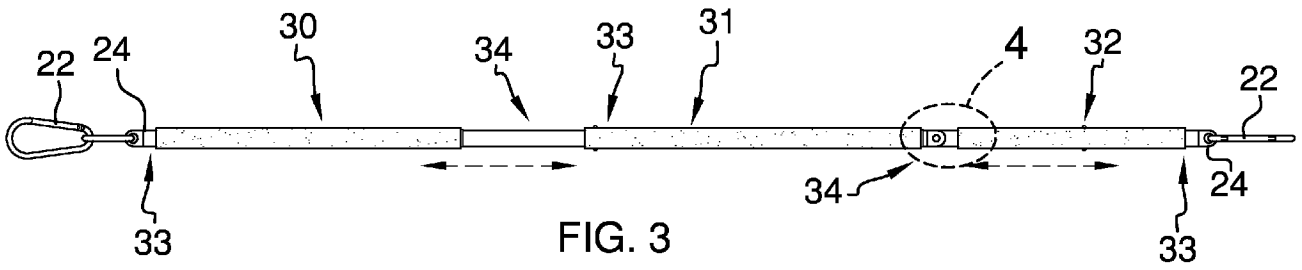
FIG. 3 is a lateral elevation view of FIG. 1.

Referring to FIG. 3, each extension comprises a proximal end 33 and a distal end 34.

Referring to FIG. 4 and again to FIG. 2, a padded cover 36 substantially covers each extension and prevents marring of any associated watercrafts or objects. The crossbar 35 also comprises one of the padded covers 36. One ring attachment 24 of the second pair of ring attachments 24 is disposed on the distal end 34 of each third extension 32.

Figure 1:
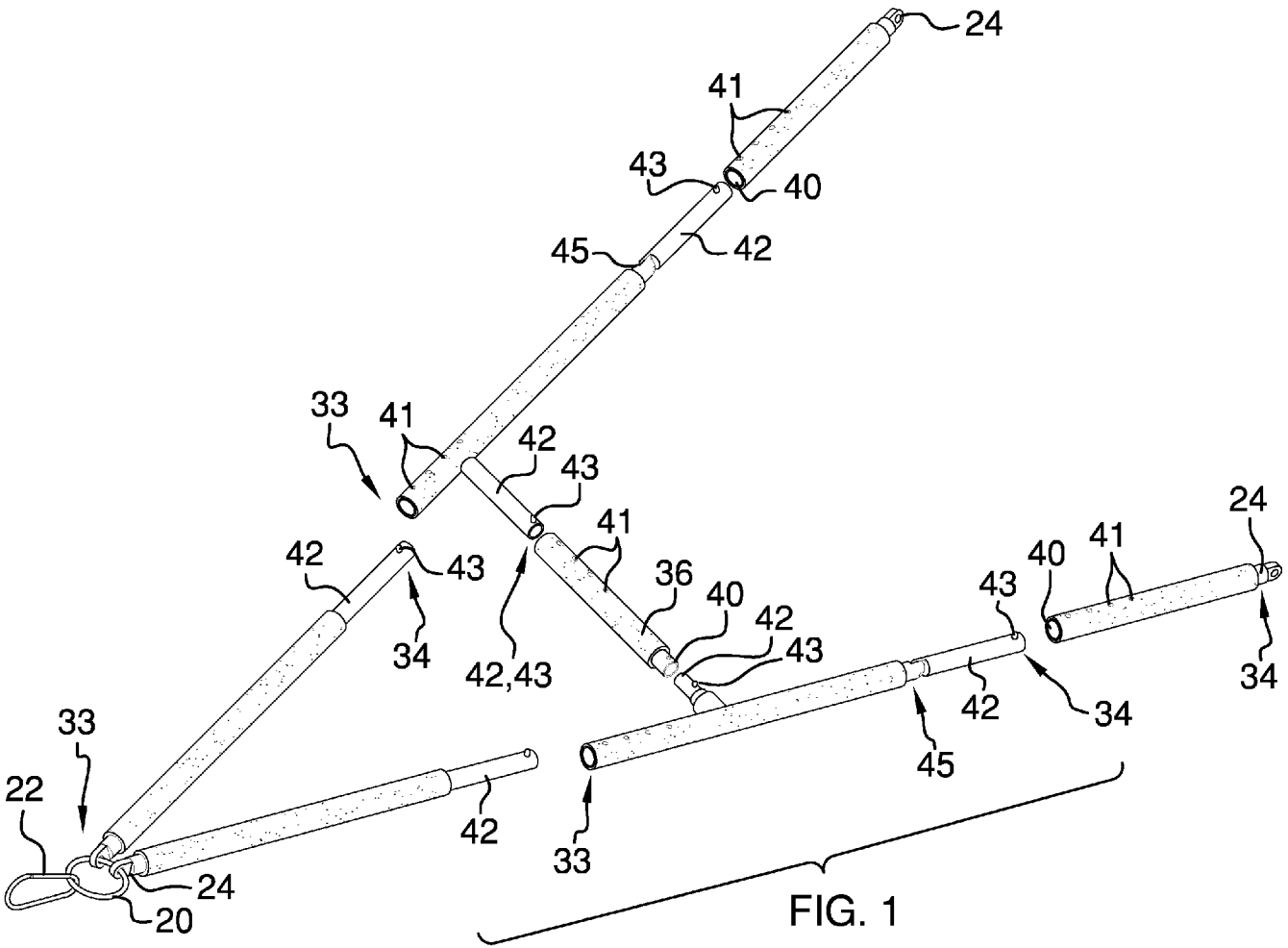
FIG. 1 is a perspective view, extensions disconnected.

Referring to FIG. 1, a combined length of each first extension 30 affixed to each second extension 31, a combined length of each second extension 31 affixed to each third section 32, and a separation distance between the two second extensions 31 are further selectively determined. The mechanism to selectively determine these lengths and this distance is partially comprised of an insert 42 with detent pin 43 disposed on the distal end 34 of each first extension 30 and each second extension 31. Another insert 42 with detent pin 43 is extended substantially perpendicularly from each second extension 31. A sleeve 40 is disposed on the proximal end 33 of each second extension 31, each third extension 32, and on an each end of the crossbar 35. A plurality of spaced apart orifices 41 is disposed in each sleeve 40. Each orifice 41 is in removable receipt of one of the detent pins 43, respectively.

Figure 4:
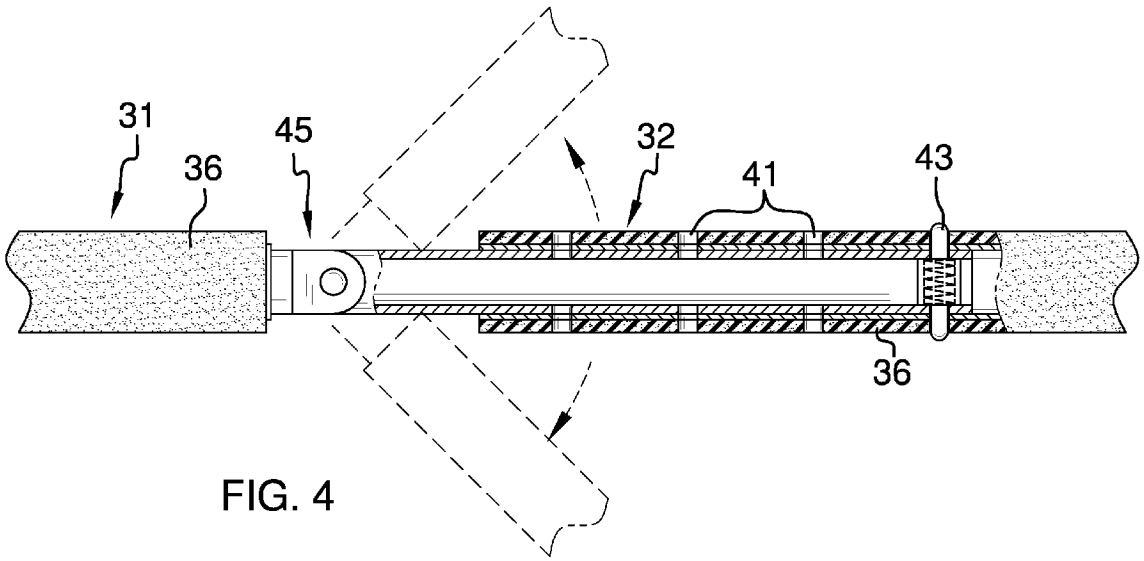
FIG. 4 is a partial cross sectional view of FIG. 3.

Referring to FIG. 4, the device 10 further comprises a pivot hinge 45 disposed near the distal end 34 of each second extension 31.

Figure 6:
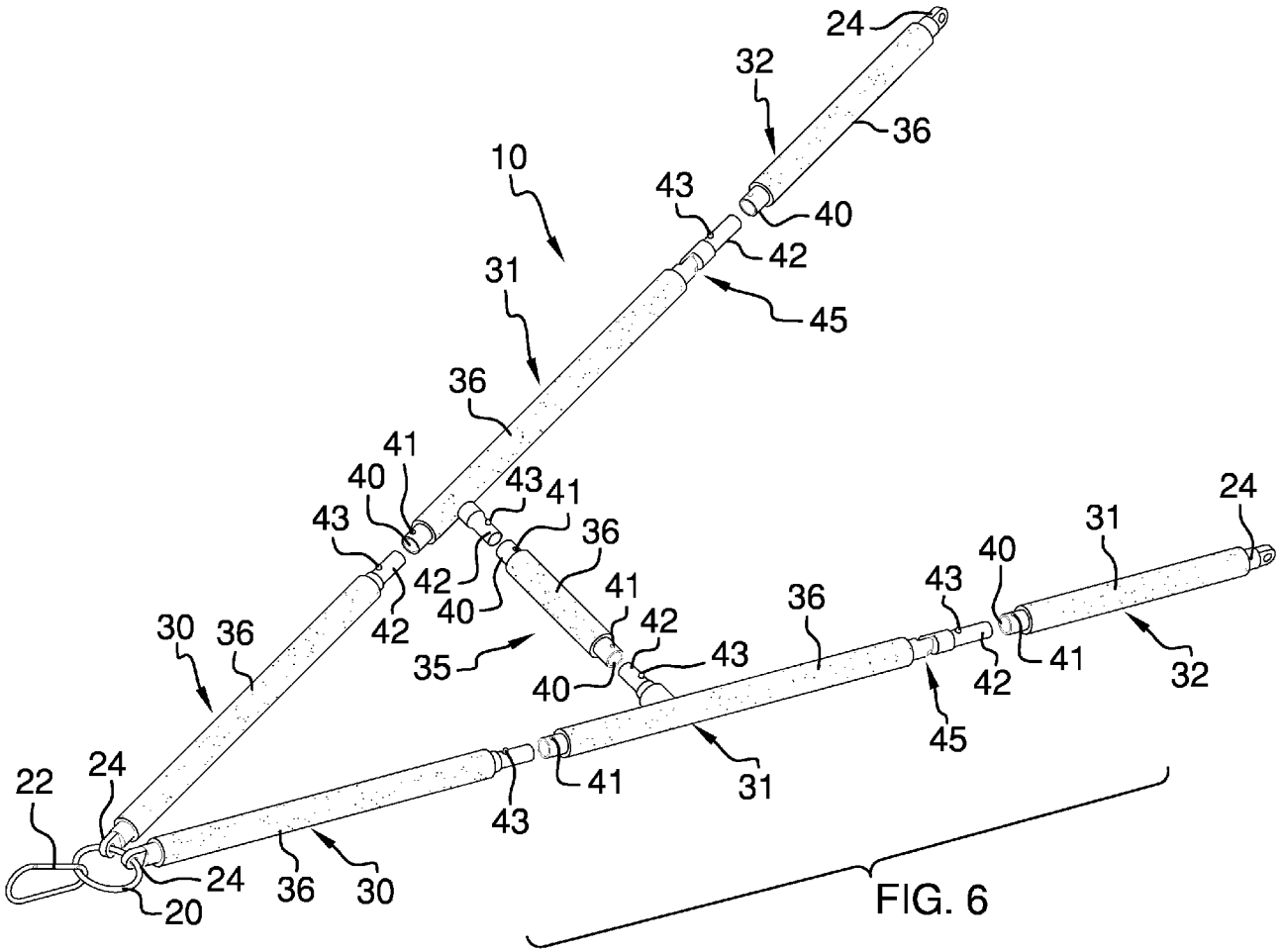
FIG. 6 is a more basic embodiment, extensions disconnected.

Referring to FIG. 6, the more basic embodiment of the device 10 is fully collapsible but does not feature adjustable length capability.

Figure 5:
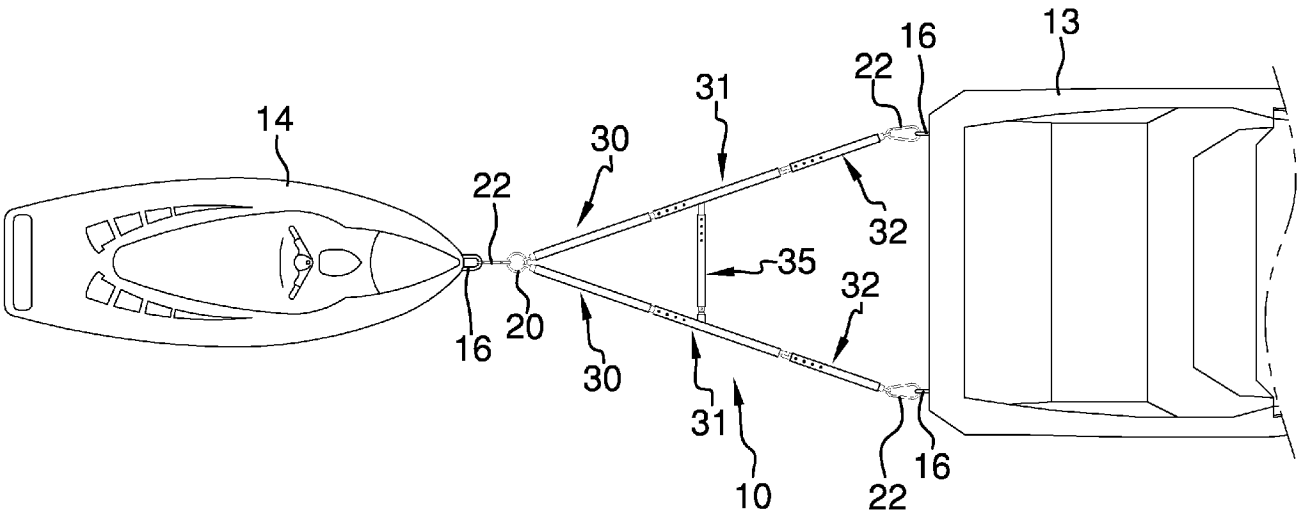
FIG. 5 is top plan in-use view.

Referring to FIG. 5, the device 10 is used to tow an existing jet ski 14 behind a tow watercraft 13. Eyelets 16 often already exist on the tow watercraft 13 and the jet ski 14, but may be installed if not.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the collapsible triangular watercraft tow device may be used.

What is claimed is:

1. A collapsible triangular watercraft tow device comprising, in combination:

a ring;

a connector removably and swivelly connected to the ring;

a plurality of ring attachments comprising a first pair of ring attachments and a second pair of ring attachments, the first pair of ring attachments swivelly and individually affixed to the ring;

a first extension affixed to an each one of the first pair of ring attachments;

a second extension removably affixed to each first extension;

a third extension removably affixed to each second extension;

a one of the second pair of ring attachments disposed on the distal end of each third extension, respectively;

a connector affixed to each third extension ring attachment.

2. The device according to claim 1 wherein each extension further comprises a padded cover.

3. A collapsible triangular watercraft tow device comprising, in combination:

a ring;

a connector removably and swivelly connected to the ring;

a plurality of ring attachments comprising a first pair of ring attachments and a second pair of ring attachments, the first pair of ring attachments swivelly and individually affixed to the ring;

a first extension affixed to an each one of the first pair of ring attachments;

a second extension removably affixed to each first extension;

a third extension removably affixed to each second extension;

a crossbar removably affixed to and connecting the second extensions;

a one of the second pair of ring attachments disposed on the distal end of each third extension, respectively;

a connector affixed to each third extension ring attachment.

4. The device according to claim 3 wherein each extension further comprises a padded cover.

5. The device according to claim 3 wherein the crossbar further comprises a padded cover.

6. The device according to claim 4 wherein the crossbar further comprises a padded cover.

7. A collapsible triangular watercraft tow device comprising, in combination:

a ring;

a connector removably and swivelly connected to the ring;

a pair of ring attachments swivelly affixed to the ring;

a first extension affixed to each ring attachment;

a second extension removably affixed to each first extension, a combined length of each first extension affixed to each second extension selectively determined;

a third extension removably affixed to each second extension, a combined length of each second extension affixed to each third extension selectively determined;

a proximal end and a distal end of each extension;

a crossbar removably affixed to each second extension, a separation distance between the two second extensions selectively determined;

a padded cover substantially covering each extension;

a ring attachment disposed on the distal end on each third extension.

8. The device according to claim 7 wherein each extension further comprises a padded cover.

9. The device according to claim 7 wherein the crossbar further comprises a padded cover.

10. The device according to claim 8 wherein the crossbar further comprises a padded cover.

11. The device according to claim 7 wherein the combined length of each first extension affixed to each second extension, the combined length of each second extension affixed to each third section, and the separation distance between the two second extensions are further selectively determined by:

an insert with detent pin disposed on the distal end of each first extension and each second extension;

an insert with detent pin extended substantially perpendicularly from each second extension;

a sleeve disposed on the proximal end of each second extension, each third extension, and on an each end of the crossbar;

a plurality of spaced apart orifices disposed in each sleeve, each orifice in removable receipt of one of the detent pins, respectively.

12. The device according to claim 8 wherein the combined length of each first extension affixed to each second extension, the combined length of each second extension affixed to each third section, and the separation distance between the two second extensions are further selectively determined by:

an insert with detent pin disposed on the distal end of each first extension and each second extension;

an insert with detent pin extended substantially perpendicularly from each second extension;

a sleeve disposed on the proximal end of each second extension, each third extension, and on an each end of the crossbar;

a plurality of spaced apart orifices disposed in each sleeve, each orifice in removable receipt of one of the detent pins, respectively.

13. The device according to claim 9 wherein the combined length of each first extension affixed to each second extension, the combined length of each second extension affixed to each third section, and the separation distance between the two second extensions are further selectively determined by:

an insert with detent pin disposed on the distal end of each first extension and each second extension;

an insert with detent pin extended substantially perpendicularly from each second extension;

a sleeve disposed on the proximal end of each second extension, each third extension, and on an each end of the crossbar;

a plurality of spaced apart orifices disposed in each sleeve, each orifice in removable receipt of one of the detent pins, respectively.

14. The device according to claim 10 wherein the combined length of each first extension affixed to each second extension, the combined length of each second extension affixed to each third section, and the separation distance between the two second extensions are further selectively determined by:

an insert with detent pin disposed on the distal end of each first extension and each second extension;

an insert with detent pin extended substantially perpendicularly from each second extension;

a sleeve disposed on the proximal end of each second extension, each third extension, and on an each end of the crossbar;

a plurality of spaced apart orifices disposed in each sleeve, each orifice in removable receipt of one of the detent pins, respectively.

15. The device according to claim 11 further comprising a pivot hinge disposed near the distal end of each second extension.

16. The device according to claim 12 further comprising a pivot hinge disposed near the distal end of each second extension.

17. The device according to claim 13 further comprising a pivot hinge disposed near the distal end of each second extension.

18. The device according to claim 14 further comprising a pivot hinge disposed near the distal end of each second extension.

* * * * *